US011573516B2

(12) United States Patent
Ogata et al.

(10) Patent No.: US 11,573,516 B2
(45) Date of Patent: Feb. 7, 2023

(54) MEASUREMENT DEVICE AND IMAGE FORMING APPARATUS

(71) Applicant: FUJIFILM Business Innovation Corp., Tokyo (JP)

(72) Inventors: Kenta Ogata, Kanagawa (JP); Kouhei Yukawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/461,969

(22) Filed: Aug. 30, 2021

(65) Prior Publication Data

US 2022/0373954 A1 Nov. 24, 2022

(30) Foreign Application Priority Data

May 20, 2021 (JP) ..... JP2021-085628

(51) Int. Cl.
*G03G 15/00* (2006.01)

(52) U.S. Cl.
CPC ..... *G03G 15/5037* (2013.01); *G03G 15/5054* (2013.01)

(58) Field of Classification Search
CPC ..... G03G 15/5037; G03G 15/5054; G03G 15/5029; G03G 2215/00763
See application file for complete search history.

(56) References Cited

U.S. PATENT DOCUMENTS

2011/0262162 A1* 10/2011 Yuge ..... G03G 15/5029 399/66
2011/0311252 A1* 12/2011 Watanabe ..... G03G 15/1675 399/45

FOREIGN PATENT DOCUMENTS

| | | |
|---|---|---|
| JP | 2002108068 | 4/2002 |
| JP | 2011137774 | 7/2011 |
| JP | 2012145819 | 8/2012 |
| JP | 2017121419 | 7/2017 |

OTHER PUBLICATIONS

"Search Report of Europe Counterpart Application", dated Mar. 15, 2022, p. 1-p. 6.

* cited by examiner

*Primary Examiner* — Sandra Brase
(74) *Attorney, Agent, or Firm* — JCIPRNET

(57) ABSTRACT

A measurement device is provided with: a measurement unit including a first mode that measures an electrical resistance of a recording medium used in an image forming apparatus in a first predetermined range of electrical resistance values and a second mode that measures the electrical resistance in a second range of electrical resistance values different from the first range, the second range and the first range being set such that with respect to the electrical resistance of multiple brands of recording media, a number of brands belonging to the second range is greater than a number of brands belonging to the first range; and a control unit that controls the measurement unit to prioritize execution of the second mode over the first mode.

20 Claims, 8 Drawing Sheets

MEASUREMENT DEVICE AND IMAGE FORMING APPARATUS

CROSS-REFERENCE TO RELATED APPLICATIONS

This application is based on and claims priority under 35 USC 119 from Japanese Patent Application No. 2021-085628 filed May 20, 2021.

BACKGROUND

(i) Technical Field

The present disclosure relates to a measurement device and an image forming apparatus.

(ii) Related Art

Japanese Unexamined Patent Application Publication No. 2011-137774 discloses a measurement terminal used to measure the resistance of a thin film using four-terminal sensing, in which the positions of the four measurement terminals are fixed such that the value obtained by dividing a measured voltage value by a current value is equal to the sheet resistance value of a thin film.

SUMMARY

A conceivable measurement device may include a first mode that measures the electrical resistance of a recording medium used in an image forming apparatus in a first predetermined range of electrical resistance values and a second mode that measures the electrical resistance in a second range of electrical resistance values different from the first range, in which the second range and the first range are set such that with respect to the electrical resistance of multiple brands of recording media, the number of brands belonging to the second range is greater than the number of brands belonging to the first range.

In the measurement device, if the execution of the first mode is prioritized over the second mode, the measurement time for measuring the electrical resistance of the recording medium may be lengthy in some cases.

Aspects of non-limiting embodiments of the present disclosure relate to shortening the measurement time for measuring the electrical resistance of the recording medium compared to a configuration that controls a measurement unit to prioritize the execution of the first mode over the second mode.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a measurement device provided with: a measurement unit including a first mode that measures an electrical resistance of a recording medium used in an image forming apparatus in a first predetermined range of electrical resistance values and a second mode that measures the electrical resistance in a second range of electrical resistance values different from the first range, the second range and the first range being set such that with respect to the electrical resistance of multiple brands of recording media, a number of brands belonging to the second range is greater than a number of brands belonging to the first range; and a control unit that controls the measurement unit to prioritize execution of the second mode over the first mode.

BRIEF DESCRIPTION OF THE DRAWINGS

An exemplary embodiment of the present disclosure will be described in detail based on the following figures, wherein.

DETAILED DESCRIPTION

Hereinafter, an exemplary embodiment of the present disclosure will be described in detail on the basis of the drawings.

(Image Forming Apparatus 10)

Figure 1:
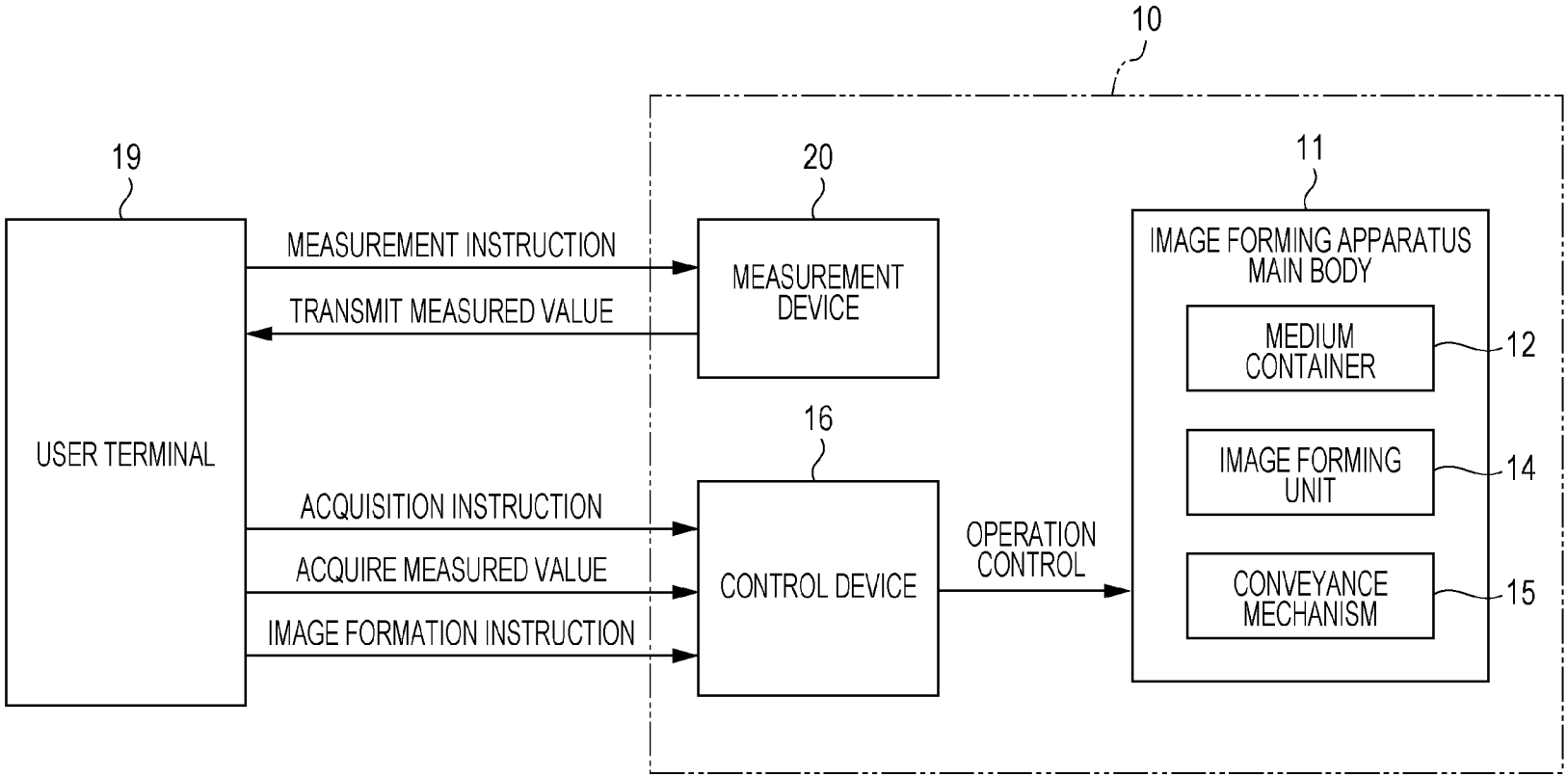
FIG. 1 is a block diagram illustrating a configuration of an image forming apparatus according to an exemplary embodiment.

A configuration of an image forming apparatus 10 according to the exemplary embodiment will be described. FIG. 1 is a block diagram illustrating a configuration of the image forming apparatus 10 according to the exemplary embodiment.

The image forming apparatus 10 illustrated in FIG. 1 is an apparatus that forms images. Specifically, as illustrated in FIG. 1, the image forming apparatus 10 is provided with an image forming apparatus main body 11, a medium container 12, an image forming unit 14, a conveyance mechanism 15, a control device 16, and a measurement device 20. The image forming apparatus 10 is capable of transmitting and receiving information with a user terminal 19. Hereinafter, each component of the image forming apparatus 10 will be described.

(Image Forming Apparatus Main Body 11)

The image forming apparatus main body 11 illustrated in FIG. 1 is a portion in which the components of the image forming apparatus 10 are provided. Specifically, the image forming apparatus main body 11 is a box-shaped housing, for example. In the exemplary embodiment, the medium container 12, the image forming unit 14, and the conveyance mechanism 15 are provided inside the image forming apparatus main body 11.

(Medium Container 12)

The medium container 12 illustrated in FIG. 1 is a portion that contains paper P in the image forming apparatus 10. The paper P contained in the medium container 12 is supplied to the image forming unit 14. Note that the paper P is one example of a "recording medium".

(Image Forming Unit 14)

The image forming unit 14 illustrated in FIG. 1 includes a function of forming an image on the paper P supplied from the medium container 12. Examples of the image forming unit 14 include an inkjet image forming unit that forms an image on the paper P using ink, and an electrophotographic image forming unit that forms an image on the paper P using toner.

In an inkjet image forming unit, an image is formed on the paper P by ejecting ink droplets from nozzles onto the paper P. In an inkjet image forming unit, an image may also be formed on the paper P by ejecting ink droplets from nozzles onto a transfer medium, and then transferring the ink droplets from the transfer medium to the paper P.

In an electrophotographic image forming unit, an image is formed on the paper P by performing the steps of charging, exposing, developing, transferring, and fusing, for example. In an electrophotographic image forming unit, an image may also be formed on the paper P by performing the charging, exposing, developing, and transferring steps to form an image on a transfer medium, transferring the image from the transfer medium to the paper P, and then fusing the image to the paper P.

Note that examples of the image forming unit are not limited to the inkjet image forming unit and the electrophotographic image forming unit described above, and any of various types of image forming units may be used.

(Conveyance Mechanism 15)

The conveyance mechanism 15 illustrated in FIG. 1 is a mechanism that conveys the paper P. As an example, the conveyance mechanism 15 conveys the paper P with conveyor members (not illustrated) such as conveyor rollers and conveyor belts. The conveyance mechanism 15 conveys the paper P from the medium container 12 to the image forming unit 14 along a predetermined conveyance path.

(Overview of User Terminal 19, Control Device 16, and Measurement Device 20)

The user terminal 19 illustrated in FIG. 1 is a terminal such as a smartphone, a tablet, or a personal computer, for example. The user terminal 19 is capable of communicating with the measurement device 20 and the control device 16 in a wired or wireless manner. As illustrated in FIG. 1, the measurement device 20 and the control device 16 are provided outside the image forming apparatus main body 11, for example. Note that each of the user terminal 19 and the control device 16 includes a control unit (control board) including a recording unit such as storage storing a program and a processor that operates according to the program.

In the exemplary embodiment, an operator (that is, a user) of the image forming apparatus 10 places desired paper P on which to form an image in the measurement device 20, and issues a measurement instruction from the user terminal 19, for example. The measurement device 20 acquires the measurement instruction from the user terminal 19, measures physical properties of the paper P, and transmits measured value information indicating measured values of the physical properties to the user terminal 19.

The operator (that is, the user) of the image forming apparatus 10 puts the paper P measured by the measurement device 20 into the medium container 12, and issues an acquisition instruction and an image formation instruction from the user terminal 19, for example. Note that the image formation instruction may also double as the acquisition instruction.

The control device 16 acquires the acquisition instruction from the user terminal 19 and acquires the measured value information from the user terminal 19. The control device 16 acquires the image formation instruction from the user terminal 19 and causes the image forming unit 14 and the conveyance mechanism 15 to execute image formation operations while also controlling the operations of the image forming unit 14 and the conveyance mechanism 15 on the basis of the measured value information. Specifically, the control device 16 controls settings such as the conveyance speed of the paper P in the conveyance mechanism 15 and also the transfer voltage and fusing temperature in the image forming unit 14 on the basis of the measured value information.

Note that in the example described above, the control device 16 is provided outside the image forming apparatus main body 11, but the control device 16 may also be provided inside the image forming apparatus main body 11. Additionally, the control device 16 acquires the measured value information from the measurement device 20 through the user terminal 19, but the control device 16 may also be configured to acquire the measured value information directly from the measurement device 20.

Furthermore, the measurement device 20 is provided outside the image forming apparatus main body 11, but the measurement device 20 may also be provided inside the image forming apparatus main body 11. Specifically, the measurement device 20 may also be configured as a device that measures physical properties in the medium container 12 or on the conveyance path of the paper P.

(Specific Configuration of Measurement Device 20)

Figure 2:
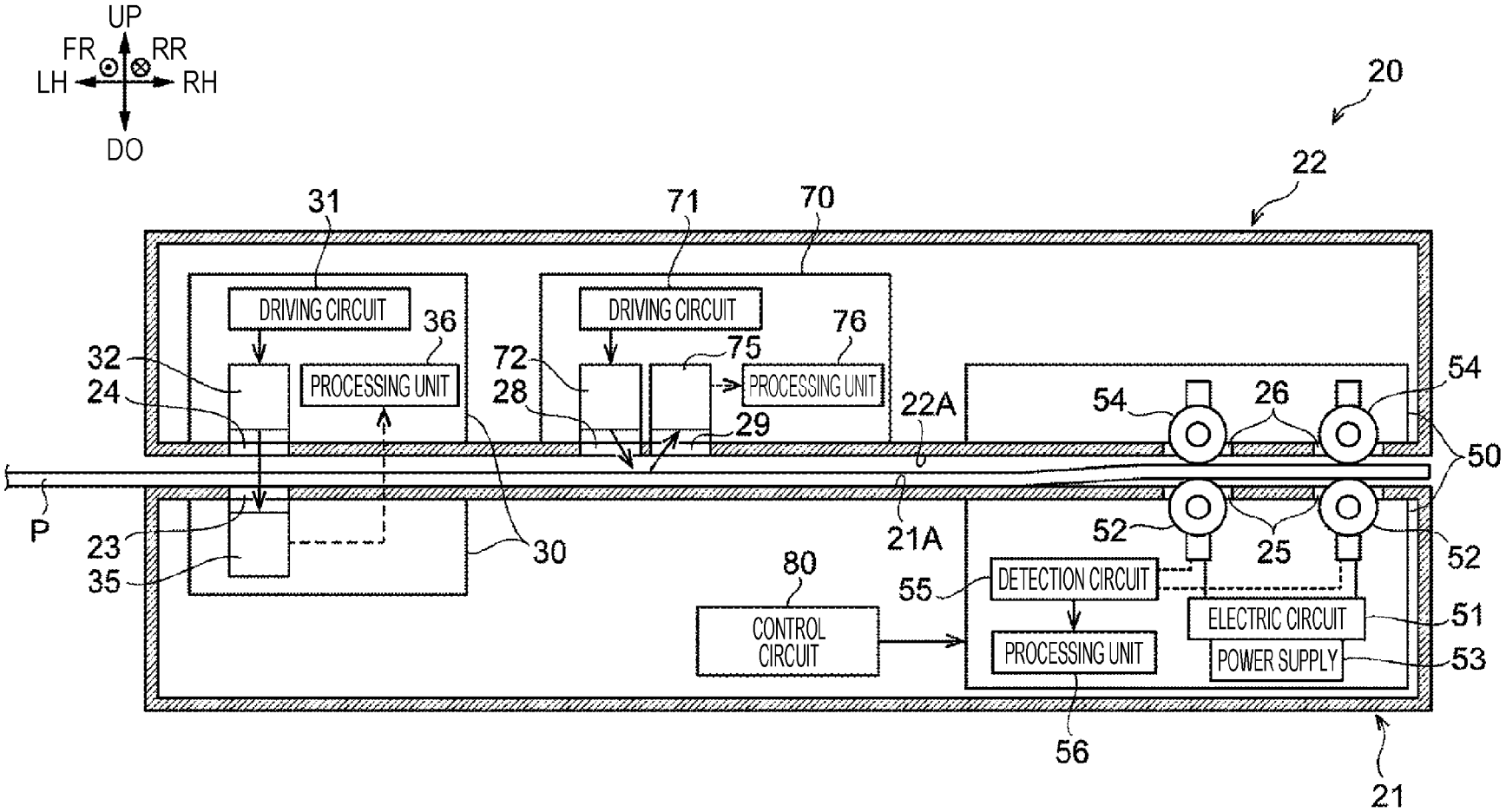
FIG. 2 is a schematic diagram illustrating a configuration of a measurement device according to the exemplary embodiment.

FIG. 2 is a schematic block diagram illustrating a configuration of the measurement device 20 according to the exemplary embodiment. Note that the arrow UP illustrated in the drawing indicates the upward (vertically upward) direction of the device, and the arrow DO indicates the downward (vertically downward) direction of the device. Also, the arrow LH illustrated in the drawing indicates the left-hand direction of the device, and the arrow RH indicates the right-hand direction of the device. Also, the arrow FR illustrated in the drawing indicates the forward direction of the direction, and the arrow RR indicates the rearward direction of the device. These directions have been defined for convenience in the following description, and the device configuration is not limited to these directions. Note that each direction of the device may be indicated while omitting the word "device" in some cases. In other words, for example, the "upward direction of the device" may simply be referred to as the "upward direction" in some cases.

Also, in the following description, the "vertical direction" is used to mean "both the upward direction and the downward direction" or "either the upward direction or the downward direction" in some cases. The "transverse direction" is used to mean "both the left-hand direction and the right-hand direction" or "either the left-hand direction or the right-hand direction" in some cases. The "transverse direction" may also be referred to as the horizontal or lateral direction. The "longitudinal direction" is used to mean "both the forward direction and the rearward direction" or "either the forward direction or the rearward direction" in some cases. The "longitudinal direction" may also be referred to as the horizontal or lateral direction. Also, the vertical direction, the transverse direction, and the longitudinal direction are mutually intersecting directions (specifically, orthogonal directions).

Also, the symbol of an "x" inside a circle "○" denotes an arrow going into the page. Also, the symbol of a dot "•" inside a circle "○" denotes an arrow coming out of the page.

The measurement device 20 is a device that measures physical properties of the paper P used in the image forming apparatus 10. Specifically, the measurement device 20 measures the basis weight, the electrical resistance, and the presence or absence of a coating layer of the paper P. Note that "measurement" means measuring a value (that is, the degree) of a physical property, and the value of a physical property is a concept that includes 0 (zero). In other words, "measurement" includes measuring whether or not the value of a physical property is 0 (zero), that is, measuring whether or not a physical property is present.

Specifically, as illustrated in FIG. 2, the measurement device 20 is provided with a first housing 21, a second housing 22, a basis weight measurement unit 30, a resistance measurement unit 50, and a coating layer measurement unit 70. Hereinafter, each unit of the measurement device 20 will be described.

(First Housing 21)

The first housing 21 is a portion in which some of the components of the measurement device 20 are provided. The first housing 21 forms the portion on the downward side of the measurement device 20. The first housing 21 has an opposing surface 21A that faces the bottom surface of the paper P. The opposing surface 21A is also a support surface that supports the paper P from underneath. Inside the first housing 21, a portion of the basis weight measurement unit 30 and a portion of the resistance measurement unit 50 are disposed.

(Second Housing 22)

The second housing 22 is a portion in which some other components of the measurement device 20 are provided. The second housing 22 forms the portion on the upward side of the measurement device 20. The second housing 22 has an opposing surface 22A that faces the top surface of the paper P. Inside the second housing 22, another portion of the basis weight measurement unit 30, the coating layer measurement unit 70, and another portion of the resistance measurement unit 50 are disposed. In the measurement device 20, the paper P given as one example of a measurement target is disposed between the first housing 21 and the second housing 22.

Note that the second housing 22 is configured to be movable relative to the first housing 21 in an approaching or retreating direction (specifically, the vertical direction), and after the paper P is disposed between the first housing 21 and the second housing 22, the second housing 22 is moved relatively in the direction approaching the first housing 21 and positioned at the position illustrated in FIG. 2.

(Basis Weight Measurement Unit 30)

The basis weight measurement unit 30 illustrated in FIG. 2 includes a function of measuring the basis weight [g/m$^2$] of the paper P by causing the paper P to vibrate using an ultrasonic wave. Specifically, as illustrated in FIG. 2, the basis weight measurement unit 30 includes a driving circuit 31, an emission unit 32, a reception unit 35, and a processing unit 36.

The emission unit 32 includes a function of emitting an ultrasonic wave at the paper P. The emission unit 32 is disposed in the second housing 22. Namely, the emission unit 32 is disposed at a position facing one surface (specifically, the top surface) of the paper P. Note that an opening 24 allowing the ultrasonic wave from the emission unit 32 to pass through to the paper P is formed underneath the emission unit 32 in the second housing 22.

The driving circuit 31 is a circuit that drives the emission unit 32. By causing the driving circuit 31 to drive the emission unit 32, the emission unit 32 imparts an ultrasonic wave to the top surface of the paper P, causing the paper P to vibrate. The vibrating paper P causes air underneath the paper P to vibrate. In other words, the ultrasonic wave from the emission unit 32 is transmitted through the paper P.

The reception unit 35 includes a function of receiving the ultrasonic wave transmitted through the paper P. The reception unit 35 is disposed in the first housing 21. Namely, the reception unit 35 is disposed at a position facing the other surface (specifically, the bottom surface) of the paper P. The reception unit 35 generates a reception signal by receiving the ultrasonic wave transmitted through the paper P. Note that an opening 23 allowing the ultrasonic wave from the paper P to pass through to the reception unit 35 is formed above the reception unit 35 in the first housing 21.

In this way, in the basis weight measurement unit 30, the emission unit 32 and the reception unit 35 form a detector (specifically, a detection sensor) that detects information (specifically, the ultrasonic wave transmitted through the paper P) indicating the basis weight of the paper P. The driving circuit 31 forms a circuit that drives the detector.

The processing unit 36 obtains a measured value by performing a process such as amplification on the reception signal acquired from the reception unit 35. Furthermore, the processing unit 36 outputs measured value information indicating the obtained measured value to the user terminal 19. The processing unit 36 is configured by an electric circuit including an amplification circuit or the like, for example.

The measured value obtained by the processing unit 36 is a value correlated with the basis weight of the paper P. Consequently, measurement in the basis weight measurement unit 30 includes not only the case of measuring the basis weight itself of the paper P, but also the case of measuring a measurement value correlated with the basis weight of the paper P.

Note that in the basis weight measurement unit 30, the basis weight of the paper P may also be calculated on the basis of the measured value obtained by the processing unit 36. Specifically, the basis weight measurement unit 30 calculates the basis weight from correlation data indicating the correlation between the measured value and the basis weight, for example.

(Coating Layer Measurement Unit 70)

The coating layer measurement unit 70 illustrated in FIG. 2 includes a function of measuring the presence or absence of a coating layer of the paper P. A coating layer is a layer formed by applying a coating agent to the surface of paper. In other words, the coating layer measurement unit 70 measures whether or not the paper P is paper with a coating (that is, coated paper). Specifically, as illustrated in FIG. 2, the coating layer measurement unit 70 includes a driving circuit 71, a light irradiation unit 72, a light reception unit 75, and a processing unit 76.

The light irradiation unit 72 includes a function of irradiating the paper P with light. The light irradiation unit 72 is disposed in the second housing 22. Namely, the light irradiation unit 72 is disposed at a position facing one surface (specifically, the top surface) of the paper P with a gap in between. Note that an opening 28 allowing the light from the light irradiation unit 72 to pass through to the paper P is formed underneath the light irradiation unit 72 in the second housing 22.

The driving circuit 71 is a circuit that drives the light irradiation unit 72. By causing the driving circuit 71 to drive the light irradiation unit 72, the light irradiation unit 72 irradiates the paper P with light, and the light reflects off the paper P.

The light reception unit 75 includes a function of receiving reflected light that has reflected off the paper P. The light reception unit 75 is disposed in the second housing 22. Namely, the light reception unit 75 is disposed at a position facing one surface (specifically, the top surface) of the paper P with a gap in between. The light reception unit 75 generates a light reception signal by receiving the reflected light that has reflected off the paper P. Note that an opening 29 allowing the light from the paper P to pass through to the light reception unit 75 is formed underneath the reception unit 75 in the second housing 22.

In this way, in the coating layer measurement unit 70, the light irradiation unit 72 and the light reception unit 75 form a detector (specifically, a detection sensor) that detects information (specifically, the reflected light reflected off the paper P) indicating the presence or absence of a coating layer of the paper P. The driving circuit 71 forms a circuit that drives the detector.

The processing unit 76 obtains a measured value by performing a process such as amplification on the light reception signal acquired from the light reception unit 75. Furthermore, the processing unit 76 outputs measured value information indicating the obtained measured value to the user terminal 19. The processing unit 76 is configured by an electric circuit including an amplification circuit or the like, for example.

The measured value obtained by the processing unit 76 is a value correlated with the presence or absence of a coating layer of the paper P. Consequently, measurement in the coating layer measurement unit 70 includes not only the case of measuring the presence or absence of a coating layer itself of the paper P, but also the case of measuring a measurement value correlated with the presence or absence of a coating layer of the paper P.

Note that in the coating layer measurement unit 70, the presence or absence of a coating layer of the paper P may also be measured on the basis of the measured value obtained by the processing unit 76. Specifically, the presence or absence of a coating layer is measured according to whether or not the measured value exceeds a predetermined threshold, for example.

(Resistance Measurement Unit 50)

The resistance measurement unit 50 illustrated in FIG. 2 includes a function of measuring the sheet resistance value [Ω] of the paper P. The resistance measurement unit 50 is an example of a "measurement unit". Sheet resistance is an example of "electrical resistance". Specifically, as illustrated in FIG. 2, the resistance measurement unit 50 includes an electric circuit 51, a pair of terminals 52, a power supply 53, a pair of opposing members 54, a detection circuit 55, and a processing unit 56.

The pair of terminals 52 are disposed in the first housing 21, for example. The pair of terminals 52 are spaced from each other by an interval in the transverse direction, and contact the bottom surface of the paper P through an opening 25 formed in the first housing 21. Each of the pair of terminals 52 is electrically connected to the power supply 53 through the electric circuit 51.

Each of the pair of opposing members 54 opposes a corresponding one of the pair of terminals 52, with the paper P disposed between the pair of opposing members 54 and the pair of terminals 52. Each of the pair of opposing members 54 contacts the top surface of the paper P through an opening 26 formed in the second housing 22. In other words, the paper P is pinched between each of the pair of opposing members 54 and each of the pair of terminals 52. As an example, each of the pair of opposing members 54 and each of the pair of terminals 52 are configured as rollers.

The power supply 53 applies a predetermined voltage ([V]) to the pair of terminals 52 through the electric circuit 51. With this arrangement, a current corresponding to the sheet resistance of the paper P flows between the pair of terminals 52. The detection circuit 55 is electrically connected to the pair of terminals 52. The detection circuit 55 generates a detection signal by detecting the current flowing between the pair of terminals 52.

In this way, in the resistance measurement unit 50, the pair of terminals 52 and the detection circuit 55 form a detector (specifically, a detection sensor) that detects information (specifically, the current flowing through the paper P) indicating the sheet resistance of the paper P. The electric circuit 51 forms a circuit that drives the detector.

The processing unit 56 obtains a measured value (specifically, a current value [A]) by performing a process such as amplification on the detection signal acquired from the detection circuit 55. Furthermore, the processing unit 56 outputs measured value information indicating the obtained measured value to the user terminal 19. The processing unit 56 is configured by an electric circuit including an amplification circuit or the like, for example.

The measured value obtained by the processing unit 56 is a value correlated with the sheet resistance value of the paper P. Consequently, measurement in the resistance measurement unit 50 includes not only the case of measuring the sheet resistance value itself of the paper P, but also the case of measuring a measurement value correlated with the sheet resistance value of the paper P. Note that in the resistance measurement unit 50, the sheet resistance value of the paper P may also be calculated on the basis of the measured value obtained by the processing unit 56.

Note that the resistance measurement unit 50 is configured to obtain the sheet resistance value by applying a predetermined voltage to the pair of terminals 52 and detecting the current flowing between the pair of terminals 52, but is not limited thereto. For example, the resistance measurement unit 50 may also be configured to obtain the sheet resistance value by passing a current with a predetermined current value through the pair of terminals 52 and detecting the voltage across the pair of terminals 52.

(Measurement Modes of Resistance Measurement Unit 50)

The resistance measurement unit 50 includes multiple measurement modes. Specifically, the resistance measurement unit 50 includes first, second, third, fourth, and fifth measurement modes. Each of the first, second, third, fourth, and fifth measurement modes is a mode that measures a predetermined range of sheet resistance values.

The first measurement mode and the fourth measurement mode are modes that measure the sheet resistance value in a measurement range exceeding 11.5 [log Ω] and up to 14.5 [log Ω] (hereinafter referred to as the high resistance measurement range (see FIG. 3)). In the first measurement mode and the fourth measurement mode, properties such as the voltage to be applied to the paper P and the amplification factor in an amplification process are set in correspondence with the high resistance measurement range.

Furthermore, the fourth measurement mode is a mode that measures the sheet resistance value with higher precision than the first measurement mode. Specifically, in the fourth measurement mode, the number of samples used to measure the sheet resistance value is increased or the measurement time is increased over the first measurement mode. More specifically, the processing unit 56 increases the number of detection signals (that is, the number of samples) to be acquired from the detection circuit 55, and performs a process such as calculating an average from the detection signals to obtain a measured value, for example.

Hereinafter, the first measurement mode will be referred to as the "high resistance measurement mode", and the fourth measurement mode will be referred to as the "high resistance measurement mode (high precision)". Note that the high resistance measurement mode is an example of a "first mode", and the high resistance measurement mode (high precision) is an example of a "fourth mode". The high resistance measurement range is an example of a "first range".

The second measurement mode and the third measurement mode are modes that measure the sheet resistance value in a measurement range exceeding 9 [log Ω] and up to 11.5 [log Ω] (hereinafter referred to as the medium resistance measurement range (see FIG. 3)). In the second measurement mode and the third measurement mode, properties such as the voltage to be applied to the paper P and the amplification factor in an amplification process are set in correspondence with the medium resistance measurement range. Specifically, in the second measurement mode and the third measurement mode, at least one of the voltage and the amplification factor is set lower than the high resistance measurement mode. In other words, in the high resistance measurement mode, at least one of the voltage to be applied to the paper P and the amplification factor is set higher than the second measurement mode and the third measurement mode. This is because in the high resistance measurement mode, current does not flow as easily as in the medium resistance measurement mode, and consequently the current detected by the detection circuit 55 is weak.

Furthermore, the third measurement mode is a mode that measures the sheet resistance value with higher precision than the second measurement mode. Specifically, in the third measurement mode, the number of samples used to measure the sheet resistance value is increased or the measurement time is increased over the second measurement mode. More specifically, the processing unit 56 increases the number of detection signals (that is, the number of samples) to be acquired from the detection circuit 55, and performs a process such as calculating an average from the detection signals to obtain a measured value, for example.

Hereinafter, the second measurement mode will be referred to as the "medium resistance measurement mode", and the third measurement mode will be referred to as the "medium resistance measurement mode (high precision)". Note that the medium resistance measurement mode is an example of a "second mode", and the medium resistance measurement mode (high precision) is an example of a "third mode". The medium resistance measurement range is an example of a "second range".

The fifth measurement mode is a mode that measures the sheet resistance value in a measurement range exceeding 4 [log Ω] and up to 9 [log Ω] (hereinafter referred to as the low resistance measurement range (see FIG. 3)). In the fifth measurement mode, values such as the voltage to be applied to the paper P and the amplification in the amplification process are set in correspondence with the low resistance measurement range. Specifically, in the fifth measurement mode, at least one of the voltage and the amplification factor is set lower than the medium resistance measurement mode. In other words, in the medium resistance measurement mode, at least one of the voltage to be applied to the paper P and the amplification factor is set higher than the fifth measurement mode. This is because in the medium resistance measurement mode, current does not flow as easily as in the low resistance measurement mode, and consequently the current detected by the detection circuit 55 is weak.

Hereinafter, the fifth measurement mode will be referred to as the "low resistance measurement mode". Note that the low resistance measurement mode is an example of a "fifth mode". The low resistance measurement range is an example of a "third range".

Figure 3:
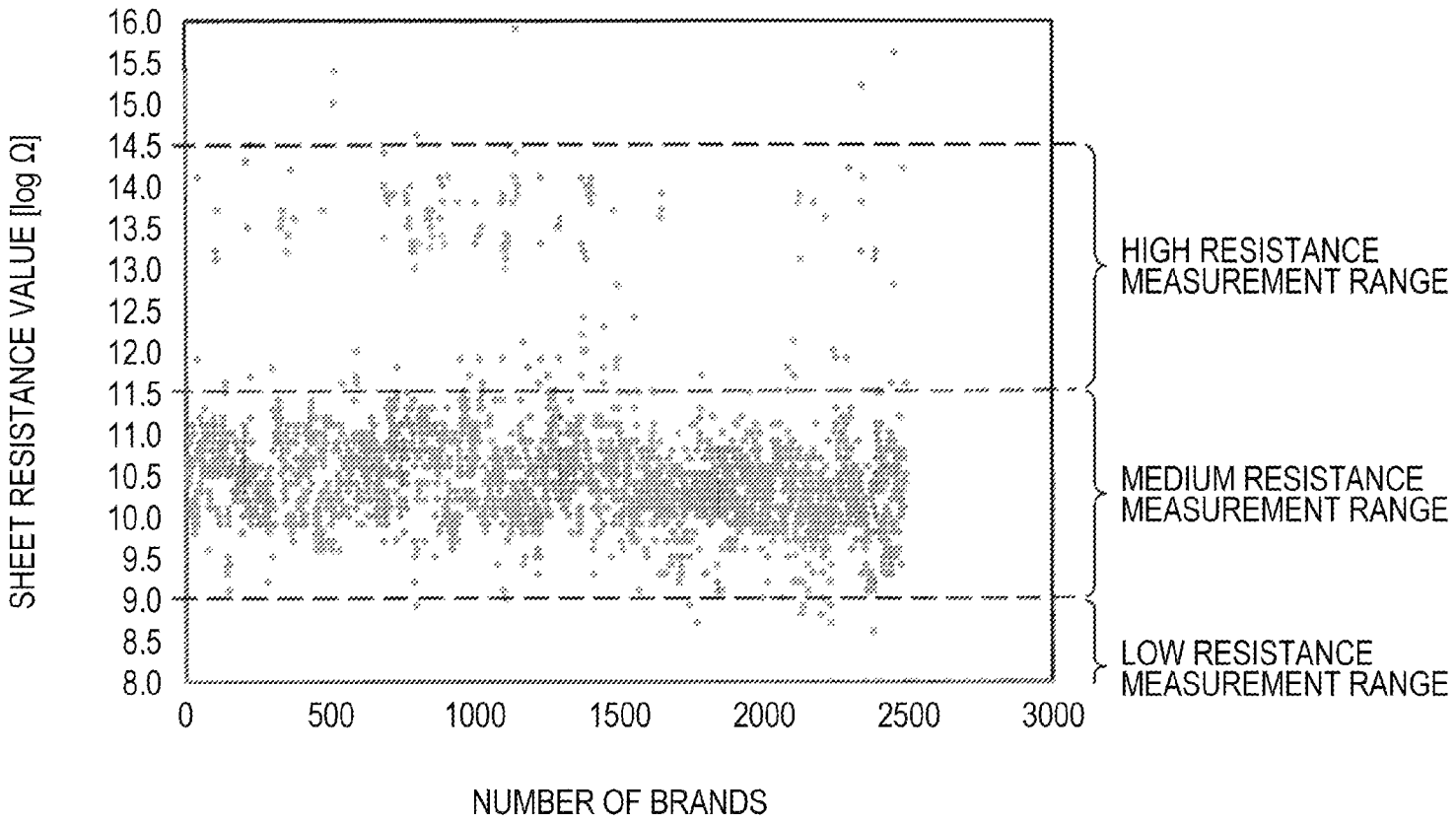
FIG. 3 is a graph for explaining measurement ranges of the measurement device according to the exemplary embodiment.

Here, as illustrated in FIG. 3, the medium resistance measurement range and the high resistance measurement range are set such that with respect to the electrical resistance of multiple brands of the paper P, the number of brands belonging to the medium resistance measurement range is greater than the number of brands belonging to the high resistance measurement range.

The high resistance measurement range and the low resistance measurement range are set such that with respect to the electrical resistance of multiple brands of the paper P, the number of brands belonging to the high resistance measurement range is greater than the number of brands belonging to the low resistance measurement range. Consequently, the number of brands belonging to each measurement range is set to increase in the order of the low resistance measurement range, the high resistance measurement range, and the medium resistance measurement range.

Note that in FIG. 3, the sheet resistance values are plotted for all brands (for example, 2506 brands) of the paper P used in the image forming device 10. As illustrated in FIG. 3, the medium resistance measurement range is set as a range to which the sheet resistance values of more than half of all brands belong. Specifically, the medium resistance measurement range is set as a range to which the sheet resistance values of over 90% of all brands belong.

(Control Circuit 80)

Figure 4:
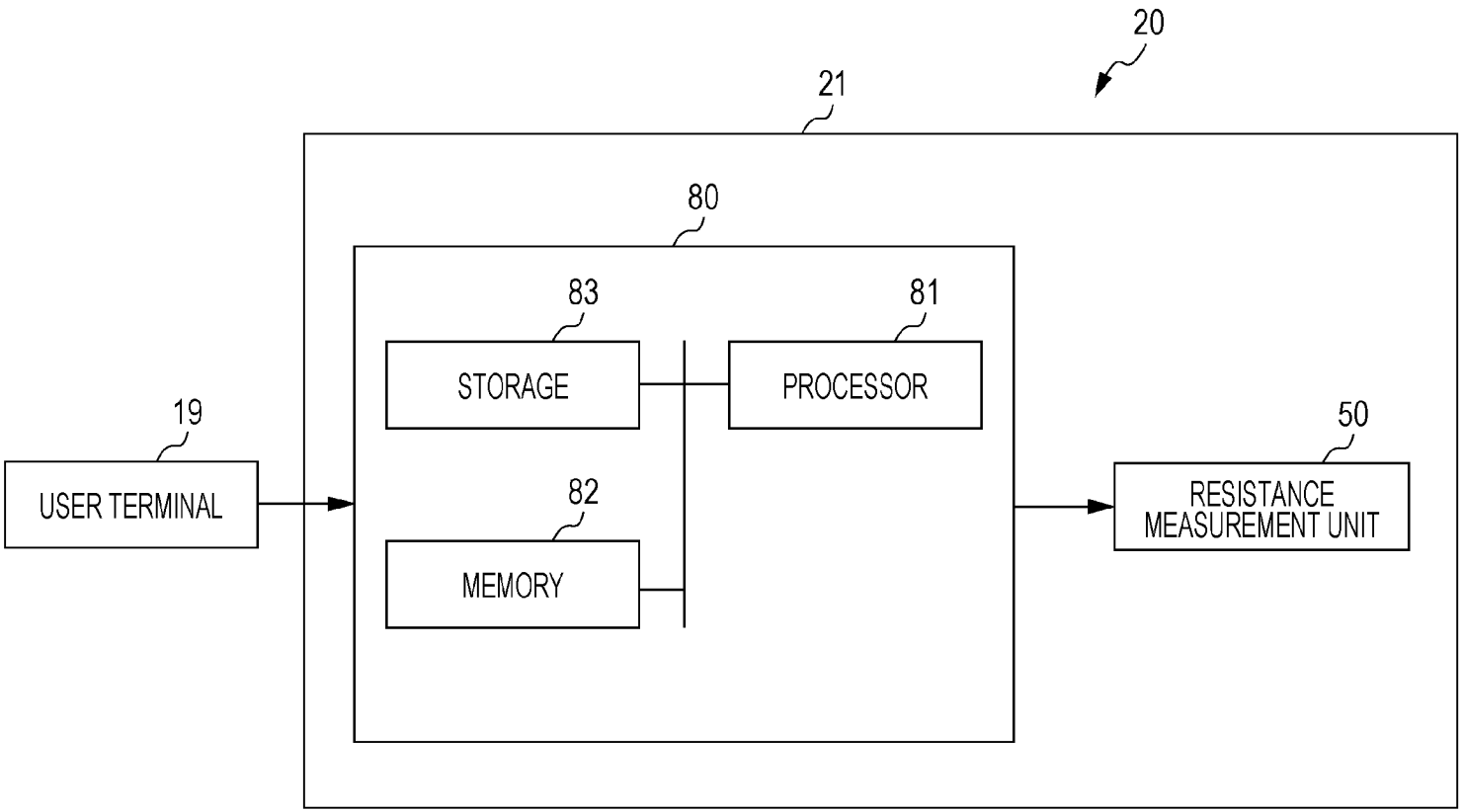
FIG. 4 is a block diagram illustrating an example of a hardware configuration of a control circuit according to the exemplary embodiment.

The control circuit 80 includes a control function that controls operations by the resistance measurement unit 50. Specifically, as illustrated in FIG. 4, the control circuit 80 includes a processor 81, a memory 82, and storage 83.

The term "processor" refers to hardware in a broad sense, and examples of the processor 81 include general processors (e.g., CPU: Central Processing Unit), dedicated processors (e.g., GPU: Graphics Processing Unit, ASIC: Application Integrated Circuit, FPGA: Field Programmable Gate Array, and programmable logic device).

The storage 83 stores various programs, including a control program 83A (see FIG. 5), and various data. The storage 83 is achieved specifically by a recording device such as a hard disk drive (HDD), a solid-state drive (SSD), or flash memory.

The memory 82 is a work area that the processor 81 uses to execute various programs, and temporarily records various programs or various data when the processor 81 executes a process. The processor 81 reads out various programs including the control program 83A from the storage 83 into the memory 82, and executes the programs using the memory 82 as a work area.

Figure 5:
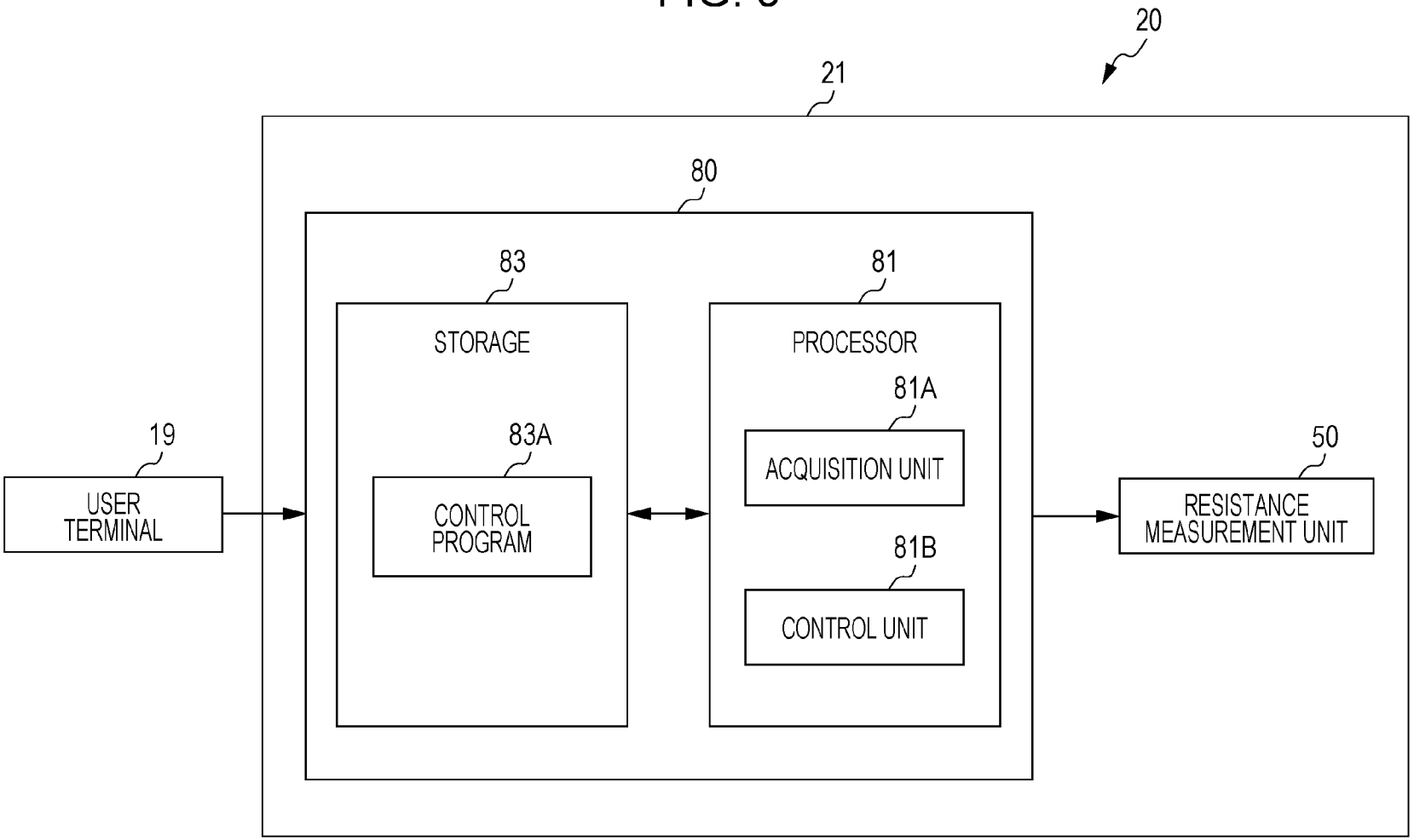
FIG. 5 is a block diagram illustrating an example of a functional configuration of a processor of the control circuit according to the exemplary embodiment.

In the control circuit 80, the processor 81 achieves various functions by executing the control program 83A. Hereinafter, a functional configuration achieved through the cooperation between the processor 81 acting as a hardware resource and the control program 83A acting as a software resource will be described. FIG. 5 is a block diagram illustrating a functional configuration of the processor 81.

As illustrated in FIG. 5, in the control circuit 80, the processor 81 executes the control program 83A to thereby function as an acquisition unit 81A and a control unit 81B.

The acquisition unit 81A acquires either an execution instruction for executing a time priority control or an execution instruction for executing a precision priority control as a measurement instruction from the user terminal 19. Note that in the exemplary embodiment, it is assumed that only execution instructions for the time priority control and the precision priority control are available as the measurement instruction. The time priority control is an example of a "first control", and the precision priority control is an example of a "second control".

The control unit 81B causes the resistance measurement unit 50 to execute the time priority control in the case where the acquisition unit 81A acquires an execution instruction for executing the time priority control. The control unit 81B causes the resistance measurement unit 50 to execute the precision priority control in the case where the acquisition unit 81A acquires an execution instruction for executing the precision priority control. In other words, the control unit 81B does not cause the resistance measurement unit 50 to execute the time priority control in the case where the acquisition unit 81A does not acquire an execution instruction for executing the time priority control.

The time priority control is a control causing the execution of the medium resistance measurement mode to be prioritized over the low resistance measurement mode and the high resistance measurement mode. Specifically, in the time priority control, the control unit 81B causes the low resistance measurement mode and the high resistance measurement mode not to be executed in the case where the sheet resistance value of the paper P measured by the medium resistance measurement mode is included in the medium resistance measurement range. In other words, in the case where the sheet resistance value of the paper P measured by the medium resistance measurement mode is included in the medium resistance measurement range, the control unit 81B ends the process without executing the low resistance measurement mode or the high resistance measurement mode.

Furthermore, in the time priority control, the control unit 81B causes the medium resistance measurement mode (high precision) to be executed in the case where the sheet resistance value of the paper P measured by the medium resistance measurement mode is included in the medium resistance measurement range.

Furthermore, in the time priority control, the control unit 81B causes the high resistance measurement mode to be executed in the case where the sheet resistance value of the paper P measured by the medium resistance measurement mode is not included in the medium resistance measurement range.

Furthermore, in the time priority control, the control unit 81B causes the high resistance measurement mode (high precision) to be executed in the case where the sheet resistance value of the paper P measured by the high resistance measurement mode is included in the high resistance measurement range.

Furthermore, in the time priority control, the control unit 81B causes the low resistance measurement mode to be executed in the case where the sheet resistance value of the paper P measured by the high resistance measurement mode is not included in the high resistance measurement range.

On the other hand, in the precision priority control, the control unit 81B causes all of the high resistance measurement mode, the medium resistance measurement mode, and the low resistance measurement mode to be executed, irrespectively of the measurement result measured by the low resistance measurement mode. Specifically, in the precision priority control, the control unit 81B causes all of the modes to be executed in the order of the low resistance measurement mode, the medium resistance measurement mode, and the high resistance measurement mode, for example.

In the exemplary embodiment, the control circuit 80 is an example of a "control unit". Note that the processor 81 or the control unit 81B may also be understood as an example of a "control unit".

(Action According to Exemplary Embodiment)

Figure 6:
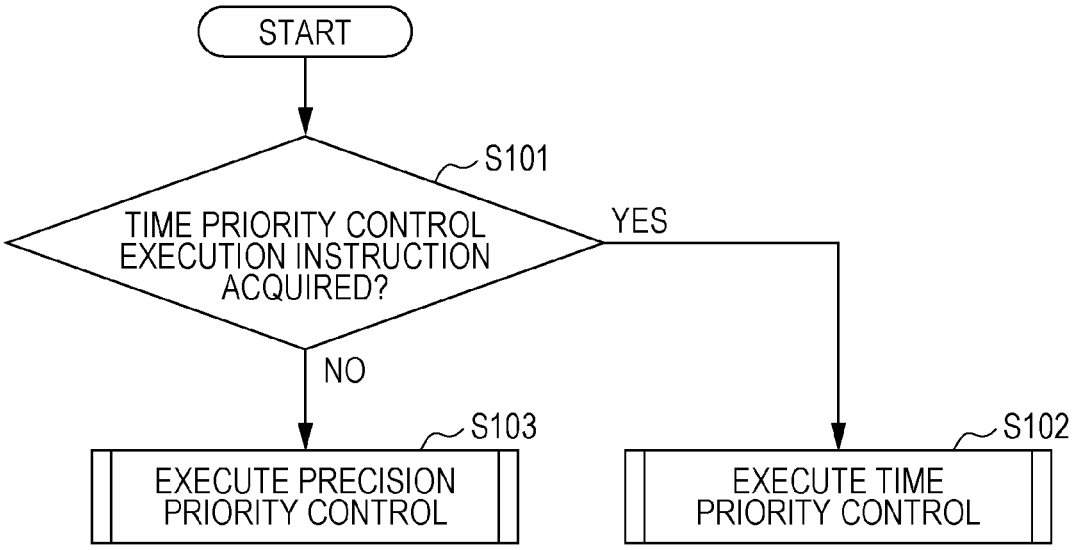
FIG. 6 is a flowchart illustrating a flow of a control process according to the exemplary embodiment.
Figure 7:
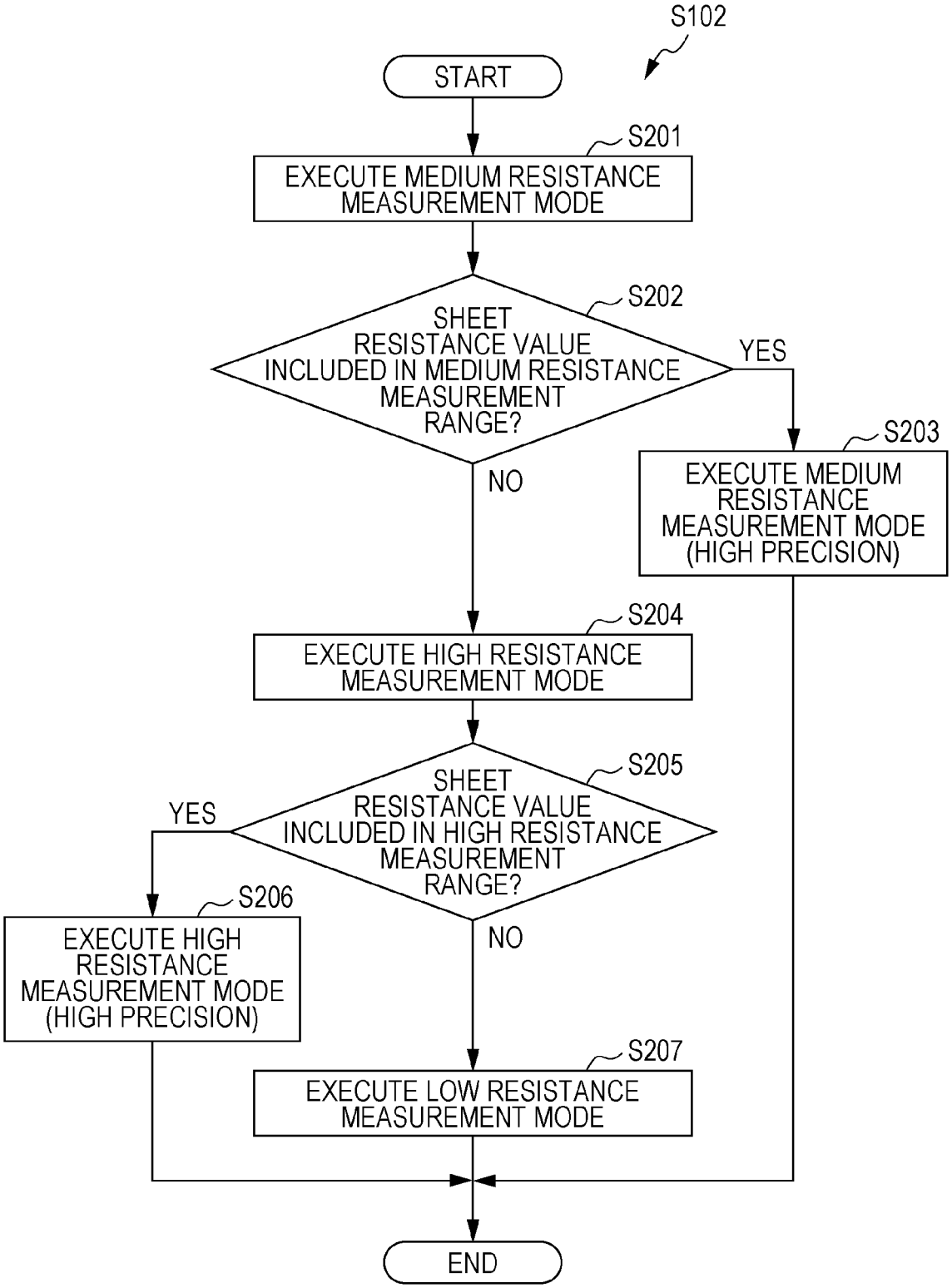
FIG. 7 is a flowchart illustrating a flow of a time priority process according to the exemplary embodiment.
Figure 8:
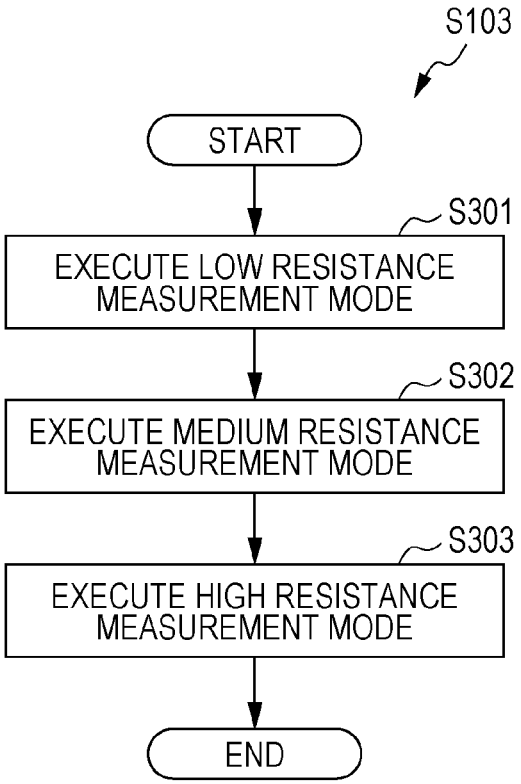
FIG. 8 is a flowchart illustrating a flow of a precision priority process according to the exemplary embodiment.

Next, an example of the action of the exemplary embodiment will be described. FIGS. 6, 7, and 8 are flowcharts illustrating the flow of a control process executed by the control circuit 80.

The process is performed by having the processor 81 read out and execute the control program 83A from the storage 83. For example, the execution of the process is started when the processor 81 acquires a measurement instruction from the user terminal 19.

As illustrated in FIG. 6, first, the processor 81 determines whether or not an execution instruction for executing the time priority control has been acquired as a measurement instruction from the user terminal 19 (step S101). In the case of determining that an execution instruction for executing the time priority control has been acquired as the measurement instruction (step S101: YES), the processor 81 causes the resistance measurement unit 50 to execute the time priority control prioritizing the execution of the medium resistance measurement mode over the high resistance measurement mode (step S102).

On the other hand, in the case of determining that an execution instruction for executing the time priority control has not been acquired as the measurement instruction (step S101: NO), the processor 81 causes the resistance measurement unit 50 to execute the precision priority control (step S103).

Note that in the exemplary embodiment, because only the execution instructions for the time priority control and the precision priority control are available as the measurement instruction, "the case where an execution instruction for executing the time priority control is not acquired as the measurement instruction" is equivalent to "the case where an execution instruction for executing the precision priority control is acquired as the measurement instruction".

As illustrated in FIG. 7, in the time priority control (step S102), the processor 81 first causes the resistance measurement unit 50 to execute the medium resistance measurement mode (step S201). Next, the processor 81 determines whether or not the sheet resistance value of the paper P measured by the medium resistance measurement mode is included in the medium resistance measurement range (step S202). In the case of determining that the sheet resistance value is included in the medium resistance measurement range (step S202: YES), the processor 81 causes the resistance measurement unit 50 to execute the medium resistance measurement mode (high precision) (step S203) and ends the process. In other words, in the case of determining that the sheet resistance value is included in the medium resistance range (step S202: YES), the processor 81 ends the process without causing the resistance measurement unit 50 to execute the high resistance measurement mode or the low resistance measurement mode.

In the case of determining that the sheet resistance value is not included in the medium resistance measurement range (step S202: NO), the processor 81 causes the resistance measurement unit 50 to execute the high resistance measurement mode (step S204). Next, the processor 81 determines whether or not the sheet resistance value of the paper P measured by the high resistance measurement mode is included in the high resistance measurement range (step S205). In the case of determining that the sheet resistance value is included in the high resistance measurement range (step S205: YES), the processor 81 causes the resistance measurement unit 50 to execute the high resistance measurement mode (high precision) (step S206) and ends the process. In other words, in the case of determining that the sheet resistance value is included in the high resistance range (step S205: YES), the processor 81 ends the process without causing the resistance measurement unit 50 to execute the low resistance measurement mode.

In the case of determining that the sheet resistance value is not included in the high resistance measurement range (step S205: NO), the processor 81 causes the resistance measurement unit 50 to execute the low resistance measurement mode (step S207) and ends the process.

As illustrated in FIG. 8, in the precision priority control (step S103), the processor 81 first causes the resistance measurement unit 50 to execute the low resistance measurement mode (step S301). Next, the processor 81 causes the resistance measurement unit 50 to execute the medium resistance measurement mode (step S302). Next, the processor 81 causes the resistance measurement unit 50 to execute the high resistance measurement mode (step S303), and ends the process.

In this way, in the precision priority control, the resistance measurement unit 50 is made to execute all of the modes of the low resistance measurement mode, the medium resistance measurement mode, and the high resistance measurement mode, without making a determination regarding the result of the sheet resistance value of the paper P measured by each measurement mode. In other words, in the precision priority control, the processor 81 causes the resistance measurement unit 50 to execute all of the modes in the order of the low resistance measurement mode, the medium resistance measurement mode, and the high resistance measurement mode, irrespectively of the measurement result measured by each measurement mode.

As above, in the exemplary embodiment, when a user of the image forming device 10 measures the sheet resistance value of the paper P, it is possible to select whether or not to execute the time priority control according to whether the user wants to prioritize time or precision, for example. In other words, with respect to measuring the sheet resistance value of the paper P, the user of the image forming device 10 is able to cause the time priority control to be executed in the case of wanting to prioritize time, and cause the precision priority control to be executed in the case of wanting to prioritize precision.

Also, in the case where an execution instruction for executing the time priority control is acquired as the measurement instruction from the user terminal 19 (step S101: YES), the processor 81 causes the resistance measurement unit 50 to execute the time priority control prioritizing the execution of the medium resistance measurement mode over the high resistance measurement mode (step S102).

With this arrangement, measurement in the medium resistance measurement range to which more brands belong compared to the high resistance measurement range is prioritized, making it possible to obtain a measurement result quickly compared to a configuration that prioritizes the execution of the high resistance measurement mode over the medium resistance measurement mode (hereinafter referred to as Configuration A). As a result, the measurement time for measuring the sheet resistance value of the paper P is shortened compared to Configuration A.

In the exemplary embodiment, as illustrated in FIG. 3, the medium resistance measurement range is set as a range to which the sheet resistance values of more than half of all brands belong, and therefore the measurement time for measuring the sheet resistance value of the paper P is shortened compared to a configuration in which the medium resistance measurement range is set as a range to which the sheet resistance values of not more than half of all brands belong.

In the time priority control, in the case where the sheet resistance value of the paper P measured by the medium resistance measurement mode is included in the medium resistance measurement range (step S202: YES), the processor 81 causes the resistance measurement unit 50 to execute the medium resistance measurement mode (high precision) (step S203).

Consequently, in the case where the sheet resistance value is included in the medium resistance measurement range (step S202: YES), the processor 81 is capable of measuring the sheet resistance value of the paper P with high precision compared to a configuration that ends the process without executing the medium resistance measurement mode (high precision).

In this way, in the case where the sheet resistance value is included in the medium resistance range (step S202: YES), the processor 81 ends the process without causing the resistance measurement unit 50 to execute the high resistance measurement mode or the low resistance measurement mode.

Consequently, the measurement time for measuring the sheet resistance value of the paper P is shortened compared to a configuration that always causes the high resistance measurement mode and the low resistance measurement mode to be executed after executing the medium resistance weight measurement mode.

Also, in the time priority control, in the case where the sheet resistance value is not included in the medium resistance measurement range (step S202: NO), the processor 81 causes the resistance measurement unit 50 to execute the high resistance measurement mode (step S204). This arrangement makes it possible to specify whether or not the sheet resistance value of the paper P is a sheet resistance value included in the high resistance measurement range.

Also, in the time priority control, in the case where the sheet resistance value of the paper P measured by the high resistance measurement mode is included in the high resistance measurement range (step S205: YES), the processor 81 causes the resistance measurement unit 50 to execute the high resistance measurement mode (high precision) (step S206).

Consequently, in the case where the sheet resistance value is included in the high resistance measurement range (step S205: YES), the processor 81 is capable of measuring the sheet resistance value of the paper P with high precision compared to a configuration that ends the process without executing the high resistance measurement mode (high precision).

Also, in the time priority control, in the case where the sheet resistance value of the paper P measured by the high resistance measurement mode is not included in the high resistance measurement range (step S205: NO), the processor 81 causes the resistance measurement unit 50 to execute the low resistance measurement mode (step S207). This arrangement makes it possible to specify whether or not the sheet resistance value of the paper P is a sheet resistance value included in the low resistance measurement range.

Also, in the exemplary embodiment, the control device 16 acquires the image formation instruction from the user terminal 19 and causes the image forming unit 14 and the conveyance mechanism 15 to execute image formation operations while also controlling the operations of the image forming unit 14 and the conveyance mechanism 15 on the basis of the measured value information. Consequently, a high-quality image is formed on the paper P compared to a configuration in which the image forming operations are executed irrespectively of the physical properties of the paper P.

(Exemplary Modifications)

In the exemplary embodiment, it is possible to selectively execute either the time priority control or the precision priority control, but the configuration is not limited thereto. For example, a configuration in which only the time priority control is executable is also possible.

In the exemplary embodiment, as illustrated in FIG. 3, the medium resistance measurement range is set as a range to which the sheet resistance values of more than half of all brands belong, but the medium resistance measurement range is not limited thereto. For example, the medium resistance measurement range may also be set as a range to which the sheet resistance values of not more than half of all brands belong. In this case, with respect to the sheet resistance value of multiple brands of the paper P, the number of brands belonging to the medium resistance measurement range is also set to be greater than the number of brands belonging to each of the high resistance measurement range and the low resistance measurement range.

In the time priority control, in the case where the sheet resistance value of the paper P measured by the medium resistance measurement mode is included in the medium resistance measurement range (step S202: YES), the processor 81 causes the resistance measurement unit 50 to execute the medium resistance measurement mode (high precision) (step S203), but is not limited thereto. For example, in the case where the sheet resistance value of the paper P measured by the medium resistance measurement mode is included in the medium resistance measurement range (step S202: YES), the processor 81 may also use the measurement value measured by the medium resistance measurement mode in step S202 as the measurement result, without executing the medium resistance measurement mode (high precision). In this case, the medium resistance measurement mode (high precision) may also be executed in in step S202.

Also, in the time priority control, in the case where the sheet resistance value of the paper P measured by the high resistance measurement mode is included in the high resistance measurement range (step S205: YES), the processor 81 causes the resistance measurement unit 50 to execute the high resistance measurement mode (high precision) (step S206), but is not limited thereto. For example, in the case where the sheet resistance value of the paper P measured by the high resistance measurement mode is included in the high resistance measurement range (step S205: YES), the processor 81 may also use the measurement value measured by the high resistance measurement mode in step S205 as the measurement result, without executing the high resistance measurement mode (high precision). In this case, the high resistance measurement mode (high precision) may also be executed in in step S205.

Also, in step S204, the processor 81 may cause the resistance measurement unit 50 to execute the low resistance measurement mode, and in step S205, the processor 81 may determine whether or not the sheet resistance value of the paper P measured by the low resistance measurement mode is included in the low resistance measurement range. In this case, in the case of determining that the sheet resistance value is included in the low resistance measurement range (step S205: YES), the processor 81 causes the resistance measurement unit 50 to execute a low resistance measurement mode (high precision) (step S206) and ends the process. On the other hand, in the case of determining that the sheet resistance value is not included in the low resistance measurement range (step S205: NO), the processor 81 causes the resistance measurement unit 50 to execute the high resistance measurement mode (step S207) and ends the process. The low resistance measurement mode (high precision) is a mode that measures the sheet resistance value with higher precision than the low resistance measurement mode. Specifically, in the low resistance measurement mode (high precision), the number of samples used to measure the sheet resistance value is increased or the measurement time is increased over the low resistance measurement mode. More specifically, the processing unit 56 increases the number of detection signals (that is, the number of samples) to be acquired from the detection circuit 55, and performs a process such as calculating an average from the detection signals to obtain a measured value, for example.

Also, in the exemplary embodiment, the paper P is used as an example of a recording medium, but the recording medium is not limited thereto. As an example of the recording medium, a sheet-like recording medium other than the paper P, such as a metal or plastic film, may also be used.

In the exemplary embodiment, the measurement device 20 is provided with the basis weight measurement unit 30 and the coating layer measurement unit 70, but is not limited thereto. For example, the measurement device 20 may also be provided with at least one of the basis weight measurement unit 30 and the coating layer measurement unit 70, but is sufficiently provided with at least the resistance measurement unit 50.

In the exemplary embodiment, the resistance measurement unit 50 that measures the sheet resistance value of the paper P is used as an example of a measurement unit, but the measurement unit is not limited thereto. As an example of the measurement unit, a measurement unit that measures the volume resistance or some other physical property of a recording medium may also be used, for example. In other words, as an example of electrical resistance, the volume resistance or some other physical property of a recording medium may also be used, for example.

The present disclosure is not limited to the exemplary embodiment above, and various modifications, alterations, and improvements are possible without deviating from the gist of the present disclosure. For example, the configurations included in the exemplary modifications described above may also be plurally combined where appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A measurement device comprising:

a measurement unit including a first mode that measures an electrical resistance of a recording medium used in an image forming apparatus in a first predetermined range of electrical resistance values and a second mode that measures the electrical resistance in a second range of electrical resistance values different from the first range, the second range and the first range being set such that with respect to the electrical resistance of a plurality of brands of recording media, a number of brands belonging to the second range is greater than a number of brands belonging to the first range; and a control unit that controls the measurement unit to prioritize execution of the second mode over the first mode.

2. The measurement device according to claim 1, wherein:

the control unit controls the measurement unit not to execute the first mode in a case where the electrical resistance of the recording medium measured by the second mode is included in the second range.

3. The measurement device according to claim 2, wherein:

in a case where the electrical resistance of the recording medium measured by the second mode is included in the second range, the control unit controls the measurement unit to measure the electrical resistance in the second range and also execute a third mode in which a number of samples used to measure the electrical resistance is increased or a measurement time is increased over the second mode.

4. The measurement device according to claim 3, wherein:

the control unit controls the measurement unit to execute the first mode in a case where the electrical resistance of the recording medium measured by the second mode is not included in the second range.

5. The measurement device according to claim 4, wherein:

in a case where the electrical resistance of the recording medium measured by the first mode is included in the first range, the control unit controls the measurement unit to measure the electrical resistance in the first range and also execute a fourth mode in which a number of samples used to measure the electrical resistance is increased or a measurement time is increased over the first mode.

6. The measurement device according to claim 5, wherein:

in a case where the electrical resistance of the recording medium measured by the first mode is not included in the first range, the control unit controls the measurement unit to execute a fifth mode that measures the electrical resistance in a third range of electrical resistance values different from the first range and the second range.

7. The measurement device according to claim 4, wherein:

in a case where the electrical resistance of the recording medium measured by the first mode is not included in the first range, the control unit controls the measurement unit to execute another mode that measures the electrical resistance in a third range of electrical resistance values different from the first range and the second range.

8. The measurement device according to claim 4, wherein:

the second range is set as a range to which the electrical resistance values of more than half of the brands belong.

9. The measurement device according to claim 3, wherein:

the second range is set as a range to which the electrical resistance values of more than half of the brands belong.

10. The measurement device according to claim 2, wherein:

the control unit controls the measurement unit to execute the first mode in a case where the electrical resistance of the recording medium measured by the second mode is not included in the second range.

11. The measurement device according to claim 10, wherein:

in a case where the electrical resistance of the recording medium measured by the first mode is included in the first range, the control unit controls the measurement unit to measure the electrical resistance in the first range and also execute another mode in which a number of samples used to measure the electrical resistance is increased or a measurement time is increased over the first mode.

12. The measurement device according to claim 11, wherein:

in a case where the electrical resistance of the recording medium measured by the first mode is not included in the first range, the control unit controls the measurement unit to execute another mode that measures the electrical resistance in a third range of electrical resistance values different from the first range and the second range.

13. The measurement device according to claim 11, wherein:

the second range is set as a range to which the electrical resistance values of more than half of the brands belong.

14. The measurement device according to claim 10, wherein:

in a case where the electrical resistance of the recording medium measured by the first mode is not included in the first range, the control unit controls the measurement unit to execute another mode that measures the electrical resistance in a third range of electrical resistance values different from the first range and the second range.

15. The measurement device according to claim 10, wherein:

the second range is set as a range to which the electrical resistance values of more than half of the brands belong.

16. The measurement device according to claim 2, wherein:

the second range is set as a range to which the electrical resistance values of more than half of the brands belong.

17. The measurement device according to claim 1, wherein:

the second range is set as a range to which the electrical resistance values of more than half of the brands belong.

18. The measurement device according to claim 1, further comprising:

an acquisition unit that acquires an execution instruction for executing the control, wherein:

the control unit:

causes the measurement unit to execute the control in a case where the acquisition unit acquires the execution instruction for executing the control, and does not cause the measurement unit to execute the control in a case where the acquisition unit does not acquire the execution instruction for executing the control.

19. The measurement device according to claim 18, wherein:

the acquisition unit acquires either an execution instruction for executing a first control or an execution instruction for executing a second control as the control, and the control unit:

causes the measurement unit to execute the first control in a case where the acquisition unit acquires the execution instruction for executing the first control, and causes the measurement unit to execute the second control that causes both the first mode and the second mode to be executed irrespectively of a measurement result measured by the measurement unit in a case where the acquisition unit acquires the execution instruction for executing the second control.

20. An image forming apparatus comprising:

the measurement device according to claim 1;

an image forming unit that forms an image on a recording medium of which the electrical resistance is measured by the measurement device; and a control device that controls an image forming operation by the image forming unit on a basis of the electrical resistance measured by the measurement device.

* * * * *